US009605903B2

(12) United States Patent
Berner et al.

(10) Patent No.: US 9,605,903 B2
(45) Date of Patent: Mar. 28, 2017

(54) GATE UNIT AND HIGH TEMPERATURE OVEN HAVING THE SAME

(75) Inventors: Karl Berner, Altdorf (DE); Peter Obstfelder, Starzach (DE)

(73) Assignee: EISENMANN AG, Boeblingen (DE)

( * ) Notice: Subject to any disclaimer, the term of this patent is extended or adjusted under 35 U.S.C. 154(b) by 1844 days.

(21) Appl. No.: 12/918,120

(22) PCT Filed: Jan. 30, 2009

(86) PCT No.: PCT/EP2009/000602
§ 371 (c)(1),
(2), (4) Date: Aug. 18, 2010

(87) PCT Pub. No.: WO2009/106199
PCT Pub. Date: Sep. 3, 2009

(65) Prior Publication Data

US 2011/0008743 A1 Jan. 13, 2011

(30) Foreign Application Priority Data

Feb. 28, 2008 (DE) ..... 10 2008 011 749

(51) Int. Cl.
*F27B 9/02* (2006.01)
*F27D 99/00* (2010.01)

(52) U.S. Cl.
CPC ..... *F27D 99/007* (2013.01); *F27B 9/028* (2013.01); *F27B 9/029* (2013.01)

(58) Field of Classification Search
USPC ..... 432/237, 128, 250, 56–57; 110/173 R, 110/175 R, 180
See application file for complete search history.

(56) References Cited

U.S. PATENT DOCUMENTS

| | | | | | |
|---|---|---|---|---|---|
| 2,804,855 | A | * | 9/1957 | Bergman | 122/498 |
| 3,155,080 | A | * | 11/1964 | Braun | 122/498 |
| 3,399,875 | A | * | 9/1968 | Ipsen | 432/65 |
| 3,410,547 | A | * | 11/1968 | Bielefeldt | 266/250 |
| 3,558,112 | A | * | 1/1971 | Gaede | 432/242 |

(Continued)

FOREIGN PATENT DOCUMENTS

| | | |
|---|---|---|
| DE | 1 533 954 A1 | 2/1970 |
| DE | 37 14 014 A1 | 11/1988 |

*Primary Examiner* — Alissa Tompkins
*Assistant Examiner* — Nathaniel Herzfeld
(74) *Attorney, Agent, or Firm* — Factor Intellectual Property Law Group, Ltd.

(57) ABSTRACT

The invention relates to a gate unit for gas-tight sealing of two adjacent high temperature zones within a high temperature oven, comprising a gate panel displaceable between an open position and a closed position within a guide structure. At least one sealing element is transported with the gate panel. Protecting means can be transported by the gate panel over at least one part of a transport path of the same, by which at least one segment of the sealing element can be protected over at least one part of the displacement path of the gate panel against influences harmful to the sealing element particularly against radiant heat. The invention further relates to a high temperature oven having an oven tunnel comprising a first high temperature zone and a second high temperature zone. The gate panel is disposed in a transition region between the first and the second high temperature zones.

19 Claims, 5 Drawing Sheets

(56) References Cited

U.S. PATENT DOCUMENTS

| | | | | |
|---|---|---|---|---|
| 4,598,732 | A * | 7/1986 | Seeger et al. | 137/334 |
| 5,425,793 | A * | 6/1995 | Mori et al. | 55/385.2 |
| 5,524,020 | A * | 6/1996 | Jhawar et al. | 373/110 |
| 5,675,098 | A * | 10/1997 | Hobbs | 73/865.6 |
| 7,544,059 | B2 * | 6/2009 | Gartz | 432/237 |
| 2007/0172786 | A1 * | 7/2007 | Katsumata | 432/206 |
| 2007/0290420 | A1 * | 12/2007 | Wunsche | 266/271 |

* cited by examiner

GATE UNIT AND HIGH TEMPERATURE OVEN HAVING THE SAME

RELATED APPLICATIONS

This application claims the filing benefit of International Patent Application No. PCT/EP2009/000602, filed Jan. 30, 2009, which claims the filing benefit of German Patent Application No. 10 2008 011 749.8 filed Feb. 28, 2008, the contents of which are incorporated herein by reference.

TECHNICAL FIELD

The invention relates to a gate unit for gas-tight separation of two adjacent high temperature zones within a high temperature oven, which comprises:

a) a gate panel displaceable between an open position and a closed position;

b) a guide structure, within which the gate panel is displaceable along a transport path;

c) at least one sealing element which is transported with the gate panel.

The invention further relates to a high temperature oven having a) an oven tunnel comprising a first high temperature zone and a second high temperature zone;

b) a gate unit disposed in a transition region between the first and the second high temperature zones, by which the high temperature zones are able to be separated from one another in a gas-tight manner.

BACKGROUND OF THE INVENTION

Such high temperature ovens in the form of vacuum furnaces are used for firing objects which have to be fired in successive oven zones in different gas atmospheres, partly at very low gas pressures. In such high temperature ovens, temperatures of up to 1800° C. may prevail during the firing process.

Firing material exists which is fired in a first oven zone in a first gas atmosphere and subsequently has to be passed through a second oven zone in which it may be fired in a second, different gas atmosphere. During the firing process, in which different gas atmospheres prevail in the successive oven zones, said two oven zones are separated from one another in a gas-tight manner by the gate panel of a gate unit mentioned in the introduction.

In known gate units, for example, a silicone seal is used as a sealing element which has a temperature resistance of 240° C., up to a maximum of 300° C. If firing material has to be transferred from one oven zone into the next, the two oven zones adjacent to one another have to be evacuated first so that it does not result in an undesirable mixing of gases when the gate panel is opened. Optionally, the oven zones may be flooded with an inert gas before the gate panel is opened.

Irrespective of whether the gate unit is used in a vacuum furnace or not, the two oven zones adjacent to one another have to be brought to the same pressure level before the gate panel is opened. Even with an oven which is not operated at low pressure, in which two oven zones adjacent to one another are flooded with different operating gases during the firing process, said two oven zones enclosing a sluice chamber have to be evacuated before the gate panel is opened; the pressure then has to be equalised, for which the oven zones may optionally be filled with an inert gas.

If the gate panel is now moved into its open position in order to open up the path between the two oven zones adjacent to one another, at least one segment of the seal passes through the hot oven tunnel.

So that this segment of the seal is not subjected to any radiant heat which is harmful thereto, the temperature in the oven tunnel of known high temperature ovens is reduced in advance to a temperature at which the silicone seal does not sustain damage. Thus, for example, temperatures of up to 550° C. are possible if the silicone seal is only briefly subjected to this temperature, which is the case when raising or lowering the gate panel.

After transferring the firing material from the first oven zone into the second oven zone, the gate panel is closed again and the oven accordingly has to be heated up again to its operating temperature of 1500° C. to 1800° C.

By lowering the temperature and the subsequent heating-up, the process of transferring firing material from one oven zone to the next is relatively lengthy and also consumes a correspondingly high amount of energy.

The present invention is directed to resolving these and other matters.

SUMMARY OF THE INVENTION

It is, therefore, an object of the invention to provide a gate unit and a high temperature oven of the type mentioned in the introduction by which and/or in which firing material may be transferred from a first oven zone into a second oven zone more rapidly and with a lower energy requirement.

This object may be achieved with regard to the gate unit of the type mentioned in the introduction, in that d) protecting means are provided which, over at least one part of the transport path of the gate panel, may be transported thereby and by which at least one segment of the sealing element can be protected over at least one part of the transport path of the gate panel against influences harmful to the sealing element, particularly against radiant heat.

The harmful influence in high temperature ovens and particularly in vacuum furnaces is provided, in particular, by radiant heat which may act on the sealing element. In known vacuum furnaces, radiation outputs of up to 500 $kW/m^2$ are reached.

As a segment of the sealing element which is subjected to the oven atmosphere when lowering or raising the gate panel is protected by the protecting means, the oven temperature no longer has to be reduced before the gate panel may be moved between its open position and its closed position. The gate panel may thus be moved at a normal operating temperature of the high temperature oven, without the sealing element being damaged. As a result, the total time period which is required for transferring firing material from a first oven zone into a second oven zone adjacent thereto is shortened, as neither a cooling phase nor a phase for reheating the oven tunnel is necessary. Moreover, in particular, the energy which previously had to be used for reheating is saved.

Advantageous developments are provided in the subclaims.

With regard to protection against radiant heat, it is particularly advantageous if the protecting means are configured as a cooling structure, by which at least one segment of the sealing element may be protected against radiant heat.

Thus it has proved advantageous if the cooling structure is a hollow profile through which a coolant may flow. Preferably water is used as coolant.

It may be advantageous if the protecting means may be moved relative to the gate panel. The purpose of this may, for example, be that at least one segment of the sealing element may be released from the protecting means in the closed position of the gate panel. Thus the relevant segment of the sealing element in the closed position of the gate panel may be protected against radiant heat, for example, by fixed structural measures which are provided on the oven in which the gate unit is used, such as a cooled opposing surface.

It has proved advantageous if the gate panel has a first main surface and a second main surface extending parallel thereto, a peripheral groove being incorporated in at least the edge region of at least one main surface, and in which a sealing ring is inserted.

If the sealing ring is tubular and inflatable and deflatable, the sealing ring in the deflated state, and thus in the slackened state, may extend below the main surface of the gate panel in which the corresponding groove is incorporated. In the inflated state, the sealing ring is then forced out of the groove beyond the corresponding main surface of the gate panel and may thus seal the corresponding opposing surface.

It is structurally advantageous if the sealing element cooperates with opposing surfaces formed by the guide structure. If the guide structure is configured, for example, as a guide rail with an inwardly open U-shaped profile, the internal flanks of the U-shaped profile may be used as opposing surfaces for the sealing element.

In order to provide an opposing surface for the segment of the sealing element which comes into contact with the oven atmosphere when the gate panel passes through the oven tunnel, in the closed position of the gate panel, it is advantageous if the guide structure comprises a receiver extending perpendicular to the direction of displacement of the gate panel, by which the gate panel is received with at least one segment of the sealing element when it adopts its closed position.

In order to maintain a protecting effect of the protecting means even in the closed position of the gate panel, it is advantageous if the protecting means in the closed position of the gate panel are arranged closer to the atmosphere to be protected than the segment of the sealing element to be protected.

With regard to the high temperature oven of the type mentioned in the introduction, the aforementioned object is achieved in that c) the gate unit according to one of claims 1 to 10 is provided as the gate unit.

The advantages associated therewith correspond to the advantages explained above relative to the gate unit.

In a high temperature oven it is advantageous if guide structure-protecting means are provided, which protect segments of the guide structure extending in the region of the oven tunnel against the atmosphere in the oven tunnel when the gate panel adopts its open position, and/or gate panel protecting means are provided, which protect the gate panel against the atmosphere in the oven tunnel when the gate panel adopts its open position.

In this manner, it may be prevented or at least avoided that segments of the guide structure are heated up by radiant heat, which subsequently come into contact again with the sealing element and would destroy said sealing element if they were to become too hot. By protecting the gate panel, the risk may be reduced that the gate panel itself is heated up by radiant heat—possibly only in one edge region—such that the seal transported with the gate panel is destroyed.

This may be implemented advantageously by the guide structure-protecting means and/or the gate panel-protecting means comprising pivotable protecting flaps.

These protecting flaps may advantageously be arranged so that they adopt a position in which they protect the gate panel against the atmospheres prevailing in the oven zones when the gate panel adopts its closed position; in particular, as a result, protection of the gate panel against radiant heat may also be ensured. In other words, the protecting flaps and the closed gate panel are present in a type of sandwich arrangement along the oven tunnel, when the gate panel adopts its closed position. In this manner, the gate panel which is cooler relative to the oven zones or the cooler external surface of the thermal insulation of the gate panel leads to reduced cooling in the vicinity thereof.

With regard to the guide structure-protecting means, which may protect the segments of the guide structure flanking the gate panel and also the above-mentioned receiver, it is advantageous if said guide structure-protecting means comprise at least one device with two flaps, which in each case may be pivoted about a rotational axis which extends parallel to segments of the guide structure to be protected by the flaps.

It is to be understood that the aspects and objects of the present invention described above may be combinable and that other advantages and aspects of the present invention will become apparent upon reading the following description of the drawings and detailed description of the invention.

An exemplary embodiment of the invention is explained in more detail hereinafter with reference to the accompanying drawings, in which:

DETAILED DESCRIPTION OF THE PRESENT INVENTION

Figure 1:
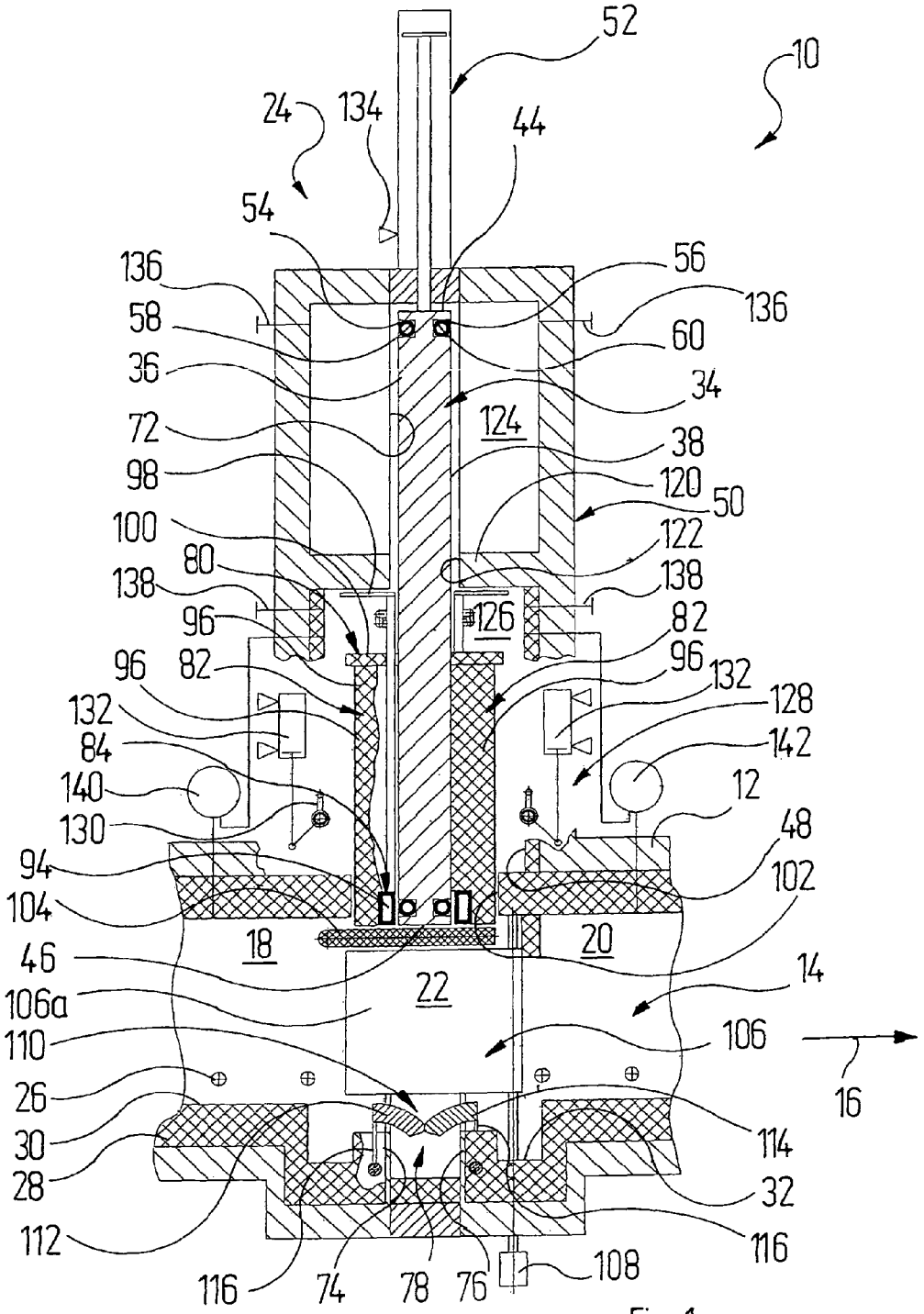
FIG. 1 shows a longitudinal section through a vacuum furnace in the region of a gate unit with a gate panel, by means of which two successive oven zones of the vacuum furnace may be separated from one another in a gas-tight manner, the gate panel being shown in its open position.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

A vacuum furnace which may be evacuated and which comprises an oven housing 12 is denoted as a whole by 10 in the figures. An oven tunnel 14 extends through the oven housing. Said oven tunnel comprises various successive oven zones in the direction of conveyance shown by an arrow 16, in which different gas atmospheres may prevail, partly at very low gas pressures, as is known per se.

Figure 3:
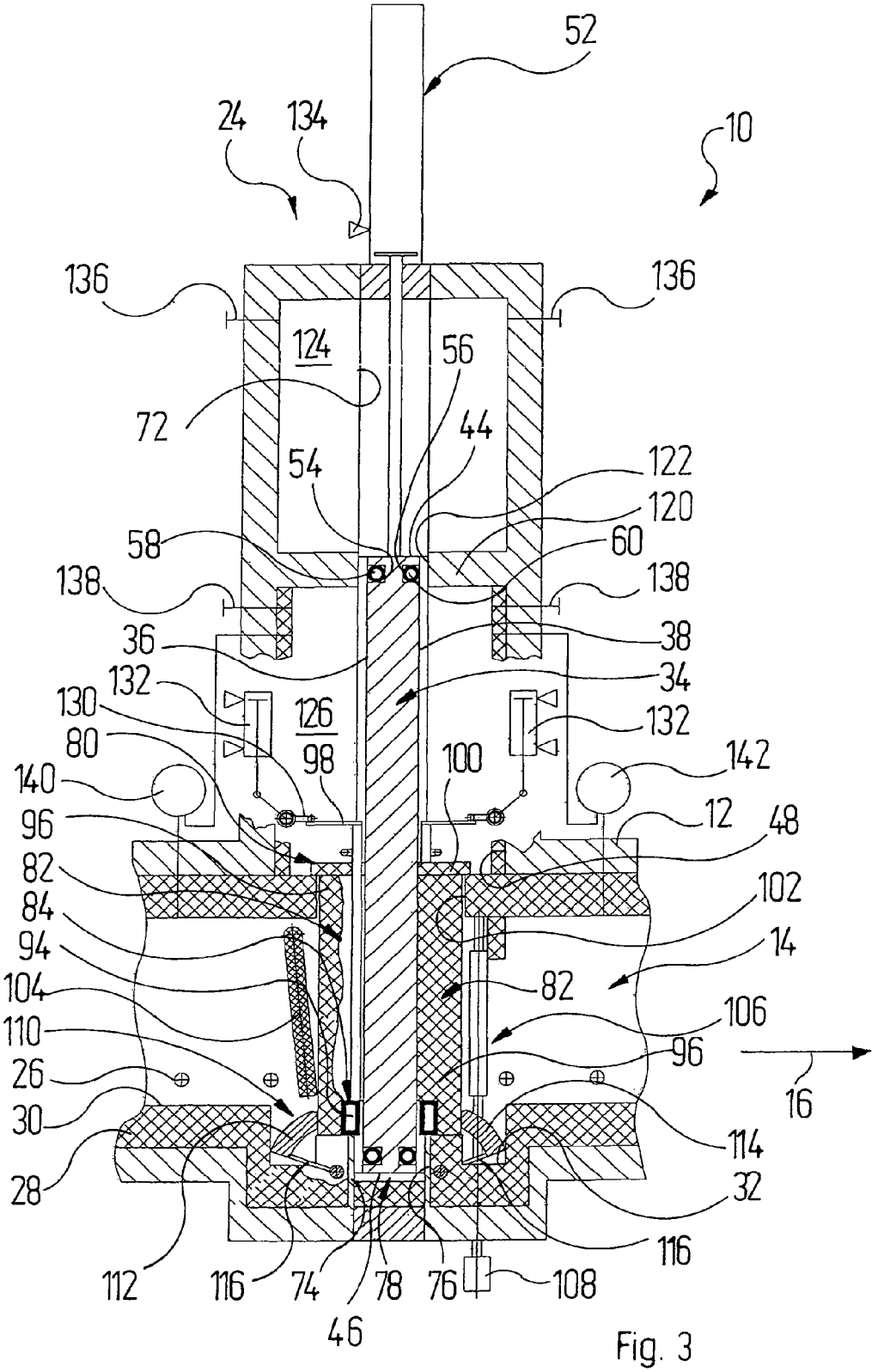
FIG. 3 shows a longitudinal section through the vacuum furnace corresponding to FIG. 1, the gate panel being shown in its closed position.
Figure 4:
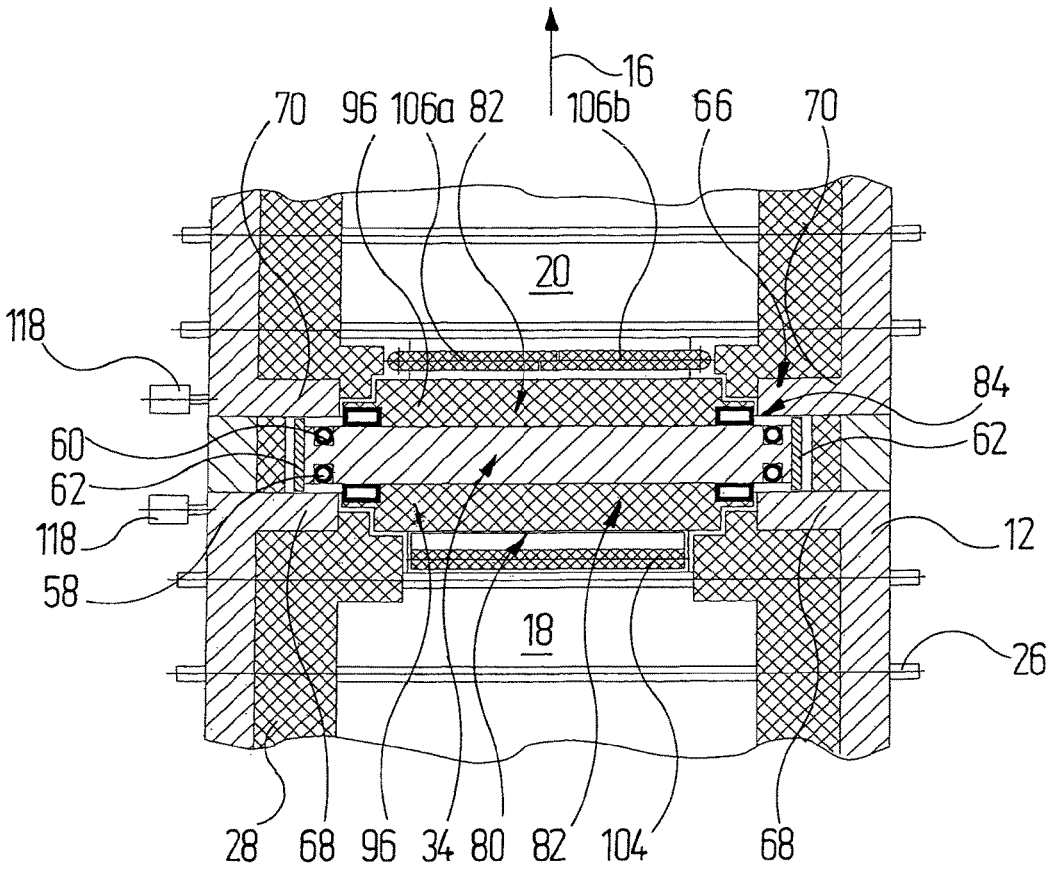
FIG. 4 shows a section through the vacuum furnace of FIG. 3 along the cutting line IV-IV there.

Of said various oven zones, two successive oven zones in the direction of conveyance 16 in the form of a first oven zone 18 and a second oven zone 20 are shown in FIGS. 1, 3 and 4, between which a transition region 22 is arranged.

By means of a gate unit 24 explained below in more detail, the transition region 22 between the oven zones 18 and 20 may optionally be opened or closed, the oven zones 18 and 20 in the latter case being separated from one another in a gas-tight manner.

Rollers 26 are arranged along the oven tunnel 14 which may be driven perpendicular to the direction of conveyance 16 and extend horizontally, and which are rotatably mounted outside the oven housing 12. Firing material is conveyed through the oven tunnel 14 by means of the rollers 26, for which the firing material may rest directly on the rollers 26 or be guided in corresponding firing supports or firing receptacles through the vacuum furnace 10.

The oven housing 12 is clad inside in the region of the oven tunnel 14 with a fireproof material 28, which permits operating temperatures of the vacuum furnace 10 of up to 1800° C. The bottom level of the two oven zones 18 and 20 is in a common horizontal bottom plane 30, whereas the bottom 32 in the transition region 22 between the oven zones 18 and 20 is lowered relative to the bottom plane 30.

Figure 2:
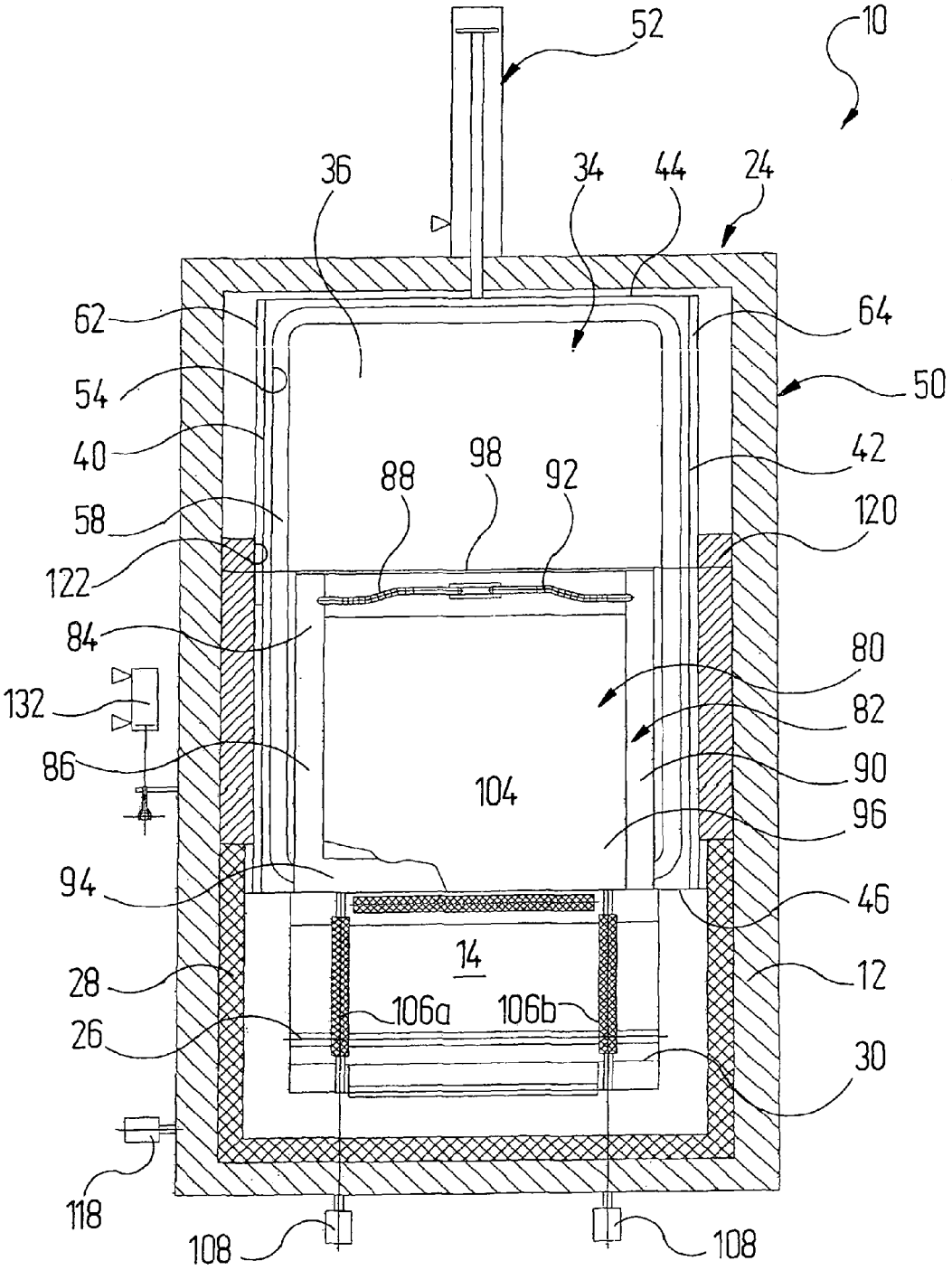
FIG. 2 shows a section through the vacuum furnace dinal direction, the thermal insulation of the gate panel being shown partially broken away.
Figure 5:
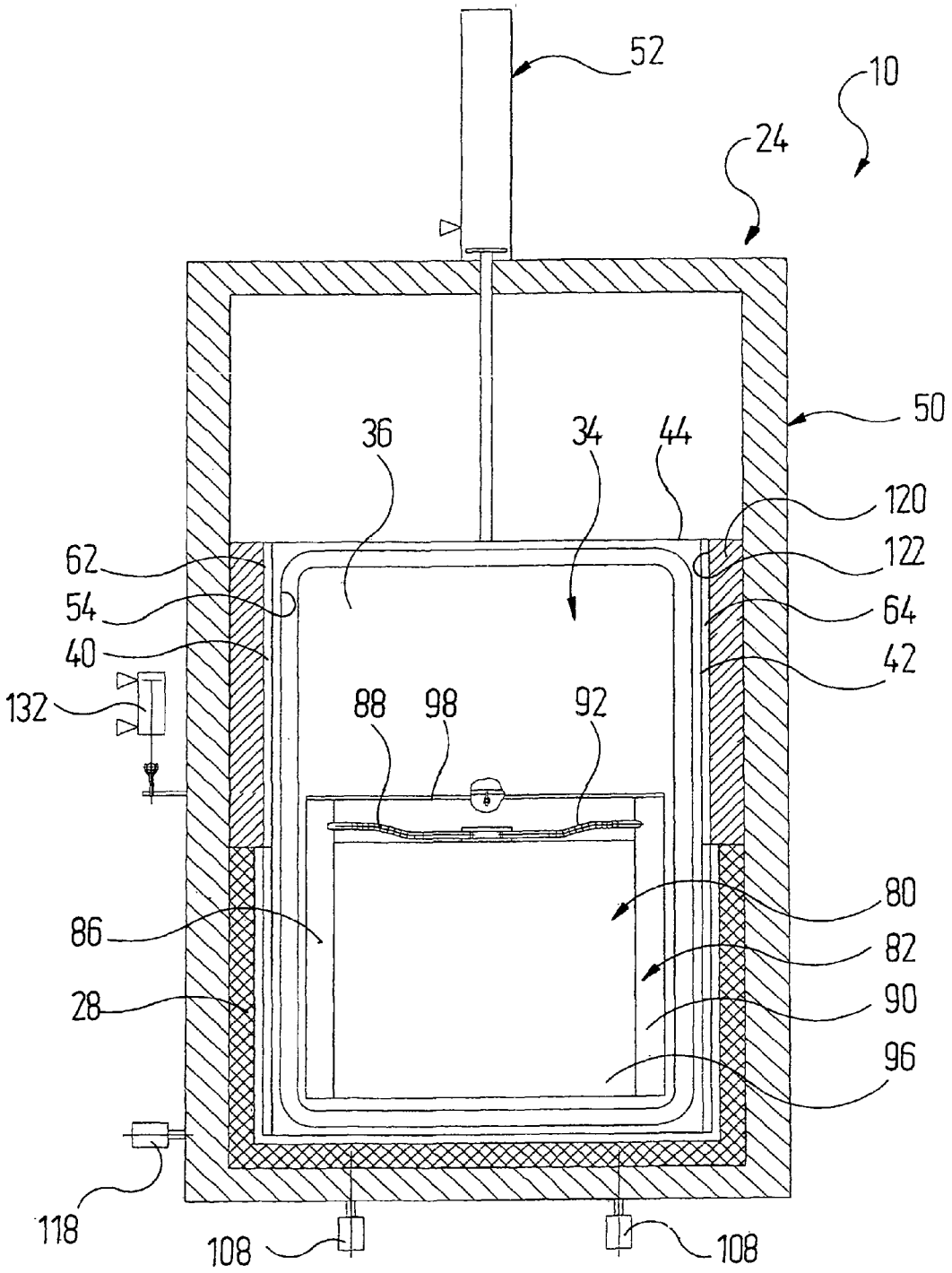
FIG. 5 shows a section through the vacuum furnace of FIG. 3 corresponding to FIG. 2.

The gate unit 24 comprises a gate panel 34 with two opposing main surfaces 36, 38 extending perpendicular to the direction of conveyance 16, two side edges 40, 42 as well as an upper edge 44 and a lower edge 46. The gate panel 34 extends upwards into a gate housing 50 through a through-opening 48 in the oven housing 12 opposing the bottom 32 in the transition region 22. At its upper edge 44, the gate panel 34 is connected to a pneumatic lifting device 52 which is not of further relevance. By means of this lifting device the gate panel 34 may be vertically moved between its open position shown in FIGS. 1 and 2 and its closed position shown in FIGS. 3 to 5.

Peripheral grooves 54 and/or 56 are incorporated into the main surfaces 36 and 38 of the gate panel 34 at a substantially uniform distance from the outer edges 40, 42 thereof 44 and 46. In each case a resilient tubular inflatable silicone seal 58 and/or 60 is incorporated into the grooves 54 and 56, which may withstand temperatures of up to a maximum of approximately 300° C. The silicone seals 58 and 60 are inflated, by gas being flowed through said seals, for which inlet and outlet connections, not shown here, are present in each case.

The silicone seals 58 and 60 are dimensioned so that they extend in the slackened state, i.e. without gas flowing through said seals, below the main surface 36 and/or 38 of the gate panel 34 in the groove 54 and/or 56. In the inflated state, the silicone seals 58 and 60 protrude beyond the main surfaces 36 and/or 38 of the gate panel 34.

The gate panel 34 carries on its side edges 40 and 42 guide plates 62 and 64 which extend parallel to the direction rection of conveyance 16 and in each case protrude beyond the main surface 36 and the main surface 38 of the gate panel 34, which may be seen in FIG. 4.

By means of these guide plates 62 and 64, the gate panel 34 runs in a vertical segment of a guide structure 66. The vertical segment of the guide structure 66 is formed in the region of the oven tunnel 18 by, in each case, two guide ribs 68, 70 arranged on each side of the gate panel 34, which flank the gate panel 34 viewed in the direction of conveyance 16 at the front and behind (see FIG. 4). In the region of the gate housing 50 the vertical segment of the guide structure 66 is formed as a groove 72 extending to the right and left of the gate panel 34 in the side walls of the gate housing 50 which extend parallel to the direction of conveyance 16, not provided separately here with a reference numeral. The vertically extending segments of the silicone seals 58 and 60 in the gate panel 34 are flanked by the guide ribs 68 and/or 70 (see FIG. 4) and/or are located inside the grooves 72.

On the bottom 32 in the transition region 22 between the first oven zone 18 and the second oven zone 20, the guide ribs 68 and 70, which in each case oppose one another on both sides of the oven housing 12, are connected by bottom ribs 74 and 76 extending between the side walls of the oven housing 12. Said bottom ribs form a bottom receiver 78 into which the gate panel 34 may retract with its lower edge 46 at the front and which completes the guide structure 66. When the gate panel 34 is retracted into the bottom receiver, the lower vertical segments of the silicone seals 58, 60 are flanked by the bottom ribs 74 and/or 76.

The gate panel 34 is cooled by water in a manner known per se. To this end, it is passed through by a channel system through which cool water is able to flow, which is not shown here in more detail.

So that the gate panel 34 may be retracted with its heat-sensitive silicone seals 58 and 60 into the oven tunnel 14 in the transition region 22 without the silicone seals 58, 60 being destroyed at temperatures of up to 1800° C. prevailing in the oven tunnel 14, the silicone seals 58 and 60 have to be protected from the high temperatures.

To this end, the gate unit 24 comprises a protective cover 80 with two partial covers 82, of which in each case one is arranged on each side of the main surface of the gate panel 34. Each partial cover 82 comprises a U-shaped hollow profile 84 as a cooling structure, one side segment 86 thereof being connected at its free end to a water inlet 88 and the other side segment 90 thereof being connected at its free end to a water outlet 92, so that cool water may flow through the hollow profile 84. The water inlet 88 and the water outlet 92 are formed as flexible tubes, whereby a relative movement of the protective cover 80 is possible relative thereto.

The lower segment 94 of the hollow profile 84 connecting the side segments 86 and 90 extends parallel to the lower edge 46 of the gate panel 34. The side segments 86 and 90 of the hollow profile 84 are arranged offset inwardly relative to the vertical segments of the silicone seal 58. The hollow profile 84 and the region framed thereby is covered by a heat protective mat 96 made of, for example, graphite felt, which extends in the vertical direction from the lower segment 94 of the hollow profile 84 to just below the connecting points with the water inlet 88 and/or water outlet 92 of the side segments 86 and 90 of the hollow profile 84.

On the upper front faces on the side segments 86 and 90 of the hollow profile 84, a retaining plate 98 is arranged extending perpendicular to the main surface 36 of the gate panel 34.

The heat protective mat 96 carries on its upper edge a protruding cover 100. The cladding made of fireproof material 28 has a through-passage 102 which is coaxial with the through-passage 48 in the oven housing 12, the cross section thereof being selected so that only a small spacing remains from the heat protective mats 96 of the protective cover 80. The protective cover 80 may be transported together with the gate panel 34 in the vertical direction but, in turn, is vertically movable relative to the gate panel 34. To this end, for each partial protection 82 an actuator is provided, not shown for the sake of clarity.

In the open position of the gate panel 34 shown in FIG. 1, the protective cover 80 adopts a vertical position, in which the lower segment 94 of the hollow profile 84 at the bottom terminates flush with the lower edge 46 of the gate panel 34. The lower segment 94 of the hollow profile 84 thus covers the segment of the silicone seal 58 extending parallel to the lower edge 46 of the gate panel 34.

In the open position of the gate panel 34 shown in FIG. 1, said gate panel and the protective cover 80 protrude through the through-opening 48 in the oven housing 12 and the through-opening 102 in the fireproof material 28 slightly into the transition region 22 in the oven tunnel 14. A top flap 104 is provided in the transition region 22. Said top flap may be pivoted by means of an actuator, not shown, between an upper position in which it is in a horizontal plane just below the through-passage 102 in the fireproof material 28 (see FIG. 1) and a folded-down position, in which it opens up the path for the gate panel 34 with the protective cover 80 into the oven tunnel 14 (see FIG. 3). The rotational axis of the top flap 104 is arranged in the transition region 22 on the side of the first oven zone 18 and extends in a horizontal plane perpendicular to the direction of conveyance 16.

In the transition region 22, moreover, a double-leafed door 106 is arranged. The door flaps 106*a*, 106*b* thereof may be pivoted by means of an actuator 108 about a vertical rotational axis in each case, which is arranged in the transition region 22 on the side of the second oven zone 20, between a first position and a second position. In the first position, the door flaps 106*a*, 106*b* are arranged parallel to the direction of conveyance 16 (see FIG. 1), whereas in the second position said door flaps are arranged perpendicular to the direction of conveyance 16 (see FIGS. 3 and 4).

The bottom receiver 78 is able to be covered and/or opened in the transition region 22 by a double-leafed bottom flap 110. To this end, the bottom flap 110 comprises two curved, winged flaps 112, 114, which are arranged so that their outwardly curved surfaces face to the inside of the oven tunnel 14. The winged flaps 112 and 114 extend along the bottom receiver 78 between the guide ribs 68 and 70 arranged on each side of the oven tunnel 14. The winged flaps 112, 114 bear in the covering position of the bottom flap 110 with their opposing longitudinal sides against one another, which may be seen in FIG. 1. On the longitudinal side opposing the respective bearing side, guide members 116 facing downwards are attached to the winged flaps 112, 114. The end thereof remote from the winged flaps 112, 114 is rotatably mounted about a horizontal rotational axis, which extends perpendicular to the direction of conveyance 16.

By means of an actuator 118, the winged flaps 112, 114 of the bottom flap 110 may be pivoted between the covering position shown in FIG. 1 and the open position shown in FIG. 3.

The gate housing 50 has an intermediate cover 120 with a through-passage 122, through which the gate panel 34 runs. The intermediate cover 120 is arranged at such a height that when the gate panel 34 adopts its closed position shown in FIG. 3, the segments of the silicone seals 58 and 60 extending along the upper edge 44 of the gate panel 34 are flanked by the respective adjacent inner peripheral surface of the through-passage 122. Thus the through-passage 122 is dimensioned so that the inflated silicone seals 58, 60 are sealed against the inner peripheral surface of the through-passage 122.

By means of the intermediate cover 120, the gate housing 50 is subdivided into an upper chamber 124 and a lower chamber 126. In the lower chamber 126, a hold-down device 128 is located with two pressure elements 130 cooperating with the retaining plates 98 of the protective cover 80. The hold-down device comprises, moreover, a position interrogation unit 132. The gate unit 24 further comprises a sensor unit 134 for detecting an entrained position of the gate panel 34. Further details will be provided below about the function of these components.

The upper chamber 124 in the gate housing 50 may be evacuated via lines 136 shown only schematically and/or subjected to a gaseous medium. Corresponding lines 138 also lead to the lower chamber 126 in the gate housing 50, each region of the lower chamber 126 adjacent to the main surfaces 36 and 38 of the gate panel 34 being able to be evacuated or flooded separately. Moreover, a differential pressure device 140 is provided which may measure a pressure difference in the lower chamber 126 of the gate housing 50 on the side of the main surface 36 of the gate panel 34 and the first oven zone 18. A corresponding differential pressure measuring device 142 is present in order to detect a pressure difference between the lower chamber 126 in the gate housing 50 on the side of the main surface 38 of the gate panel 34 and the second oven zone 20.

The above-described vacuum furnace 10 functions as follows:

As already mentioned, the vacuum furnace 10 may be operated at a temperature of up to 1800° C. In the open position of the gate panel 34 shown in FIG. 1, the path in the transition region 22 between the first oven zone 18 and the second oven zone 20 is free. Material to be fired may thus be moved by the rollers 26 from the first oven zone 18 into the second oven zone 20. The outer surfaces of the top flap 104 facing the oven tunnel 14, the double-leafed door 106 as well as the bottom flap 110 are subjected to the radiant heat produced in the oven tunnel 14 and have a correspondingly high temperature. The top flap 104 protects in its upper position the lower segments 94 of the hollow profiles 84 of the protective cover 80 through which cold water substantially flows from the hot interior of the oven tunnel 14, so that heat losses through the cold hollow profiles 84 are substantially avoided.

So that the oven zones 18 and 20 may be subjected to different gases, the oven zones 18 and 20 have to be separated from one another in a gas-tight manner.

Initially, to this end the top flap 104 is moved by means of the associated actuator into its folded-down position shown in FIG. 3, whereby the through-passage 48 in the oven housing 12 and the through-passage 102 in the fireproof material 28 are opened. The door flaps 106*a*, 106*b* of the double-leafed door 106 are pivoted by means of the actuators 108 into their position also shown in FIG. 3, in which they are perpendicular to the direction of conveyance 16.

The gate panel 34 is now moved downwards by the pneumatic lifting device 52. At the same time, the protective cover 80 is transported so that the lower segment 94 of the hollow profile 84, through which cool water flows, is always arranged level with and in front of the segment of the silicone seal 58 and/or 60, which extends parallel to the lower edge 46 of the gate panel 34.

The wing flaps 112, 114 of the bottom flap 110 are pivoted by means of the actuator 118, so that the bottom receiver 78 is opened in the transition region 22 of the oven tunnel 14.

The gate panel 34 and the protective cover 80 are retracted together in the above-mentioned relative position into the oven tunnel 14, until the lower segments 94 of the hollow profiles 84 of the protective cover 80 come to rest on the bottom ribs 74 and/or 76 of the bottom receiver 78, whereby the movement of the protective cover 80 is halted. The gate panel 34 is, however, moved slightly further downwards, until the segments of the silicone seals 58 and 60 extending parallel to the lower edge 46 of the gate panel 34 are flanked by the bottom ribs 74 and/or 76 of the bottom receiver 78.

As already mentioned above, the segments of the silicone seals 58 and 60, which extend parallel to the side edges 40 and 42 of the gate panel 34, are located in each case between the guide ribs 68 and 70 of the guide structure 66. The side segments 86 and 90 of the hollow profile 84 which are offset to the inside provide a protection against radiant heat from the oven tunnel 14, whereby the temperature of the silicone seals 58 and 60 is always kept at its maximum highest temperature in its vertical segments.

The same effect is produced by the lower segments 94 of the hollow profile 84 for the horizontal segments of the silicone seals 58 and 60 when passing through the oven tunnel 14.

By the folded-down top flap 104 and the closed double-leafed door 106, the oven zones 18 and 20 are protected relative to the water-cooled gate panel 34 as well as the protective cover 80 which is also water-cooled so that objects to be fired, which are arranged in the oven zones 18, 20 adjacent to the transition region 22, are not subjected to any cooling or only a small amount of cooling.

This protection is effective, in particular, because both the top flap 104 and the doors of the double-leafed door 106 always turn the same outer surface towards the firing material in the inside of the oven tunnel 14, irrespective of which position they adopt. In this manner, cold or colder surfaces in the oven tunnel 14 are substantially avoided.

When the gate panel 34 adopts its lowermost position shown in FIG. 3, in which it is retracted with its lower edge segment into the bottom receiver 78, the silicone seals 58 and 60 are inflated, so that it presses against the opposing surfaces formed by the bottom ribs 74, 76, the guide ribs 78, 70 and the inner wall surfaces of the grooves 72 in the gate housing 50 and the relevant inner surfaces of the through-passage 122 of the intermediate cover 120 of the gate housing 50.

As the silicone seals 58 and 60 also seal the through-passage 122 in the intermediate cover 120 of the gate housing 50, the upper chamber 124 thereof and the lower chamber 126 thereof are separated from one another in a gas-tight manner. Also, the partial regions of the lower chamber 126 of the gate housing 50, which in each case are located on the side of the main surface 36 and/or the main surface 38 of the gate panel 34, are insulated from one another.

When moving the gate panel 34 down, a vacuum is generated in the gate housing 50 whereby hot gas could be drawn from the oven tunnel 14 through the through-passages 48 and 102 in the oven housing 12 into the gate housing 50. At the same time, however, hot gas would flow past the silicone seals 58 and 60, which could destroy said seals.

For this reason, the differential pressure measuring devices 140, 142 are provided, which compare the pressure prevailing in the gate housing 50 with the pressure prevailing in the first oven zone 18 and/or in the second oven zone 20. By means of a control unit, not shown here separately, by means of the lines 136 and/or 138 a pressure equalisation may take place so that in the corresponding region of the gate housing 50 a pressure prevails which is not lower or higher than in the oven zones 18 and/or 20.

In the lower position of the gate panel 34 and the protective cover 80, the cover 100 is positioned on the heat protective mats 96 of the protective cover 80 from outside on the fireproof material 28 in the region of the through-passage 48 in the oven housing 12. As a result, a complementary protection of the gate housing 50 relative to the oven tunnel 14 is produced.

As may be seen in FIG. 3, in the lower position of the gate panel 34 and the protective cover 80, the pressure elements 130 of the hold-down device 128 are arranged so that they press from above against the retaining plates 98 of the protective cover 80, whereby both partial covers 82 are held in their lower position. When the gate panel 34 is pushed upwards again at a predetermined time by the pneumatic lifting device 52, the protective cover 80 initially does not move therewith under any circumstances.

Thus in the case, for example, of being carried along with the gate panel 34 the protective cover 80 is prevented from being immediately moved upwards. In this case, the lower segments 94 of the hollow profiles 84 would be arranged above the segments of the silicone seals 58 and 60 extending parallel to the lower edge 46 of the gate panel 34. As a result, when lifting the gate panel 34 the silicone seals 58 and 60 would be directly subjected to the hot oven atmosphere and the radiant heat and would be destroyed. Only after the gate panel 34 is moved upwards sufficiently far that the corresponding segments of the silicone seals 58 and 60 are flanked by the lower segments 94 of the hollow profiles 84 of the protective cover 80, does the correspondingly positioned sensor 134 react to detect the entrained position of the gate panel 34. As a result of an output signal thereof, the hold-down device 128 is activated so that the pressure elements 130 adopt their position shown in FIG. 1, and open the retaining plates 98 of the protective cover 80. Then the protective cover 80 is moved upwards together with the gate panel 34, the lower segments 94 of the hollow profile 84 always protecting the silicone seals 58 and 60 from the hot oven atmosphere and, as a result, from the radiant heat produced in the oven tunnel 14.

Before the gate panel 34 is moved again together with the protective cover 80 upwards into its open position, so that the path for the firing material is free from the first oven zone 18 to the second oven zone 20, initially the gas flow is interrupted by the tubular silicone seals 58 and 60. The seals 58, 60 slacken and no longer protrude beyond the main surfaces 36, 38 of the gate panel 34.

When the gate panel 34 has been moved into its open position, the top flap 104 is again folded upwards, so that the through-passage 102 in the fireproof material 28 and thus the lower edge 46 and the cool lower segments 94 of the hollow profiles 84 are protected from the radiant heat. Also, the door 106 between the transition region 22 and the oven zone 24 is opened again. In the position shown in FIG. 1, the door flaps **106*a* and 106*b* of the door 106 protect the guide ribs 68 and 70 of the guide structure 66 against the hot oven atmosphere and the radiant heat generated in the oven tunnel 14. This is necessary so that the guide ribs 68 and 70 are not able to heat up, as long as the gate panel 34 adopts its open position. Otherwise, in the region between the guide ribs 68 and 70 a temperature could be created at which the silicone seals 58 and 60 of the gate panel 34 would be destroyed, if they were to retract again into the guide ribs 68 and 70 when lowering the gate panel 34. For the same reason, the bottom flap 110 is closed, so that it protects the bottom receiver 78** from the hot oven atmosphere and the radiant heat.

By means of the bottom flap 110, firing material additionally moved beyond said bottom flap is protected from being cooled too greatly by the colder region located therebelow, when the firing material is transferred from the first oven zone 18 into the second oven zone 20.

By means of the protective cover 80 moving with the gate panel 34, the silicone seals 58 and 60 of the gate panel 34 may be moved through the oven tunnel 14, although the temperature is considerably higher therein than the maximum operating temperature of the silicone seals 58 and 60 actually permitted. In this manner, the path between the oven zones 18 and 20 may be opened up, without the atmosphere in the oven tunnel 14 having to be previously cooled.

In the event of the failure of just one of the two inflatable seals 58, 60, the oven may still continue to be operated. Such a malfunction does not necessarily lead to an immediate production failure.

In a modification, not shown, the gate panel 34 may also be provided with a seal 58 or 60 on only one of its main surfaces 36 or 38 and be correspondingly provided with partial protection 82 there. In this case, the gate unit 24 may be used, for example, at the inlet or outlet of the vacuum furnace 10.

In a modification, also not shown, instead of the inflatable seals 58, 60 a non-inflatable seal may also be provided. To this end, a pressing device may additionally be incorporated in the gate panel 34, by means of which the seal in the closed position of the gate panel 34 is pressed against the corresponding opposing surfaces of the guide structure 66, in order to achieve a sealing action.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A gate unit for gas-tight separation of two adjacent high temperature zones within a high temperature oven, which comprises:

a) a gate panel displaceable between an open position and a closed position;

b) a guide structure, within which the gate panel is displaceable along a transport path;

c) at least one sealing element which is transported with the gate panel, characterised in that d) protecting means are provided which, over at least one part of the transport path of the gate panel, may be transported thereby and by which at least one segment of the sealing element can be protected over at least one part of the transport path of the gate panel against influences harmful to the sealing element, particularly against radiant heat, wherein the protecting means are configured as a cooling structure, by which at least one segment of the sealing element may be protected against radiant heat.

2. The gate unit of claim 1, wherein the cooling structure is a hollow profile through which a coolant may flow.

3. The gate unit of claim 1, wherein at least one segment of the sealing element may be moved away from the protecting means in the closed position of the gate panel.

4. The gate unit of claim 1, wherein the gate panel has a first main surface and a second main surface extending parallel thereto, a peripheral groove being incorporated in at least the edge region of at least one main surface, and in which a seal is arranged.

5. The gate unit of claim 4, wherein the seal is tubular and inflatable and deflatable.

6. The gate unit of claim 1, wherein the gate unit is designed so that the protecting means in the closed position of the gate panel are arranged closer to the atmosphere to be protected than the segment of the sealing element to be protected.

7. A high temperature oven having a) an oven tunnel comprising a first high temperature zone and a second high temperature zone;

b) a gate unit disposed in a transition region between the first and the second high temperature zones, by which the high temperature zones-are able to be separated from one another in a gas-tight manner, wherein the gate unit comprises a gate panel displaceable between an open position and a closed position;

a guide structure, within which the gate panel is displaceable along a transport path;

at least one sealing element which is transported with the gate panel, characterised in that protecting means are provided which, over at least one part of the transport path of the gate panel, may be transported thereby and by which at least one segment of the sealing element can be protected over at least one part of the transport path of the gate panel against influences harmful to the sealing element, particularly against radiant heat.

8. The high temperature oven of claim 7, wherein guide structure-protecting means are provided, which protect segments of the guide structure extending in the region of the oven tunnel against the atmosphere in the oven tunnel when the gate panel adopts its open position, and/or gate panel-protecting means are provided, which protect the gate panel against the atmosphere in the oven tunnel when the gate panel adopts its open position.

9. The high temperature oven of claim 8, wherein the guide structure-protecting means and/or the gate panel-protecting means comprise pivotable protecting flaps.

10. The high temperature oven of claim 9, wherein the protecting flaps of the guide structure-protecting means and/or the gate panel-protecting means adopt a position in which they protect the gate panel against the atmospheres prevailing in the oven zones when the gate panel adopts its closed position.

11. The high temperature oven of claim 7 wherein at least one segment of the sealing element may be moved away from the protecting means in the closed position of the gate panel.

12. The high temperature oven of claim 7 wherein the gate panel has a first main surface and a second main surface extending parallel thereto, a peripheral groove being incorporated in at least the edge region of at least one main surface, and in which a seal is arranged.

13. A gate unit for gas-tight separation of two adjacent high temperature zones within a high temperature oven, which comprises:

a) a gate panel displaceable between an open position and a closed position;

b) a guide structure, within which the gate panel is displaceable along a transport path;

c) at least one sealing element which is transported with the gate panel, characterised in that d) protecting means are provided which, over at least one part of the transport path of the gate panel, may be transported thereby and by which at least one segment of the sealing element can be protected over at least one part of the transport path of the gate panel against influences harmful to the sealing element, particularly against radiant heat, wherein the protecting means may be moved relative to the gate panel.

14. A gate unit for gas-tight separation of two adjacent high temperature zones within a high temperature oven, which comprises:

a) a gate panel displaceable between an open position and a closed position;

b) a guide structure, within which the gate panel is displaceable along a transport path;

c) at least one sealing element which is transported with the gate panel, characterised in that d) protecting means are provided which, over at least one part of the transport path of the gate panel, may be transported thereby and by which at least one segment of the sealing element can be protected over at least one part of the transport path of the gate panel against influences harmful to the sealing element, particularly against radiant heat, wherein the sealing element cooperates with opposing surfaces formed by the guide structure.

15. A gate unit for gas-tight separation of two adjacent high temperature zones within a high temperature oven, which comprises:

a) a gate panel displaceable between an open position and a closed position;

b) a guide structure, within which the gate panel is displaceable along a transport path;

c) at least one sealing element which is transported with the gate panel, characterised in that d) protecting means are provided which, over at least one part of the transport path of the gate panel, may be transported thereby and by which at least one segment of the sealing element can be protected over at least one part of the transport path of the gate panel against influences harmful to the sealing element, particularly against radiant heat, wherein the guide structure comprises a receiver extending perpendicular to the direction of displacement of the gate panel, by which the gate panel is received with at least one segment of the sealing element when it adopts its closed position.

16. A high temperature oven having a) an oven tunnel comprising a first high temperature zone and a second high temperature zone;

b) a gate unit disposed in a transition region between the first and the second high temperature zones, by which the high temperature zones-are able to be separated from one another in a gas-tight manner, wherein the gate unit comprises a gate panel displaceable between an open position and a closed position;

a guide structure, within which the gate panel is displaceable along a transport path;

at least one sealing element which is transported with the gate panel, characterised in that protecting means are provided which, over at least one part of the transport path of the gate panel, may be transported thereby and by which at least one segment of the sealing element can be protected over at least one part of the transport path of the gate panel against influences harmful to the sealing element, particularly against radiant heat, wherein guide structure-protecting means are provided, which protect segments of the guide structure extending in the region of the oven tunnel against the atmosphere in the oven tunnel when the gate panel adopts its open position, and/or gate panel-protecting means are provided, which protect the gate panel against the atmosphere in the oven tunnel when the gate panel adopts its open position, and further wherein the guide structure-protecting means comprise at least one device with two flaps, which in each case may be pivoted about a rotational axis which extends parallel to segments of the guide structure to be protected by the flaps.

17. A high temperature oven having a) an oven tunnel comprising a first high temperature zone and a second high temperature zone;

b) a gate unit disposed in a transition region between the first and the second high temperature zones, by which the high temperature zones are able to be separated from one another in a gas-tight manner, c) wherein the gate unit comprises a gate panel displaceable between an open position and a closed position;

a guide structure, within which the gate panel is displaceable along a transport path;

at least one sealing element which is transported with the gate panel, characterised in that protecting means are provided which, over at least one part of the transport path of the gate panel, may be transported thereby and by which at least one segment of the sealing element can be protected over at least one part of the transport path of the gate panel against influences harmful to the sealing element, particularly against radiant heat, and wherein the protecting means are configured as a cooling structure, by which at least one segment of the sealing element may be protected against radiant heat.

18. The high temperature oven of claim 17, wherein the cooling structure is a hollow profile through which a coolant may flow.

19. A high temperature oven having a) an oven tunnel comprising a first high temperature zone and a second high temperature zone;

b) a gate unit disposed in a transition region between the first and the second high temperature zones, by which the high temperature zones are able to be separated from one another in a gas-tight manner, wherein the gate unit comprises:

a gate panel displaceable between an open position and a closed position;

a guide structure, within which the gate panel is displaceable along a transport path;

at least one sealing element which is transported with the gate panel, characterised in that protecting means are provided which, over at least one part of the transport path of the gate panel, may be transported thereby and by which at least one segment of the sealing element can be protected over at least one part of the transport path of the gate panel against influences harmful to the sealing element, particularly against radiant heat, and wherein the protecting means may be moved relative to the gate panel.

* * * * *